United States Patent [19]

Dröscher et al.

[11] 4,368,918

[45] Jan. 18, 1983

[54] PROCESS AND APPARATUS FOR CONTROLLING THE WATER SUPPLY TO THE CUTTING HEAD OF A CUTTING MACHINE

[75] Inventors: Erich Dröscher, Scheifling; Herwig Wrulich, Zeltweg; Alfred Zitz, Zeltweg; Otto Schetina, Zeltweg, all of Austria

[73] Assignee: Voest-Alpine Aktiengesellschaft, Vienna, Austria

[21] Appl. No.: 217,502

[22] Filed: Dec. 17, 1980

[30] Foreign Application Priority Data

Jan. 23, 1980 [AT] Austria ..... 361/80

[51] Int. Cl.[3] ..... E21C 35/22

[52] U.S. Cl. ..... 299/1; 251/63.4; 91/170 R; 173/58

[58] Field of Search ..... 299/1, 81, 12; 173/58; 251/63.4; 91/170 R

[56] References Cited

U.S. PATENT DOCUMENTS

| | | | |
|---|---|---|---|
| 3,381,761 | 5/1968 | Hansson | 173/58 X |
| 3,980,338 | 9/1976 | Weber | 299/1 |
| 4,186,649 | 2/1980 | Sundstrom | 91/170 R |

FOREIGN PATENT DOCUMENTS

| | | | |
|---|---|---|---|
| 1358512 | 3/1964 | France | 251/63.4 |

*Primary Examiner*—Ernest R. Purser

*Attorney, Agent, or Firm*—Cushman, Darby & Cushman

[57] ABSTRACT

For reducing the amount of water consumed, supply of water to the cutting head of a cutting machine shall be given free only if different operating conditions are simultaneously occurring. The proposed process contemplates to provide the possibility to supply water to the cutting head only with the rotational movement of the cutting head being switched-on and to give free the water supply only if simultaneously at least one further operating condition such as, for example, a movement of the cutting arm or a movement of the machine is occurring.

The apparatus for performing this process contemplates a device for switching-in a water pump, said device being coupled with a device for switching-in the rotational drive of the cutting head. For this purpose, a series of control pistons 2, 3, 4, 5 and 6 are arranged within a common cylinder 1, the working spaces of each individual control piston being connected via conduits 15, 16, 17, 18 and 19 with the working spaces of the associated hydraulic aggregates for the movement of the cutting arm and, respectively, the machine. The control pistons 2, 3, 4, 5 and 6 are coupled one with the other in direction of the pressure supplied and loaded in opposite direction to this direction by a spring 8. Shifting movement of one of the control pistons 2, 3, 4, 5 and 6, which control pistons can be shifted independently one from the other, thus, together with the water pump being switched on, effects release of supply of water to the cutting head (FIG. 1).

4 Claims, 2 Drawing Figures

Figure 1:
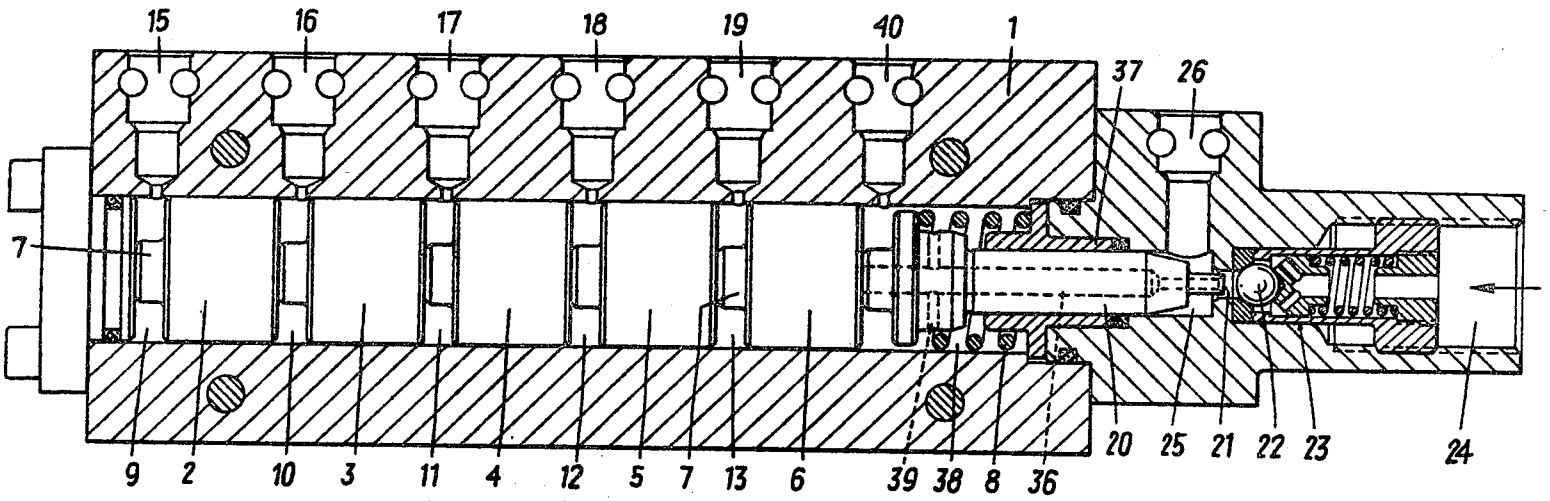

PROCESS AND APPARATUS FOR CONTROLLING THE WATER SUPPLY TO THE CUTTING HEAD OF A CUTTING MACHINE

It is known to cool with water the bits of a cutting head of a cutting machine. It is also possible to rinse the gap between the cutting arm and the rotating cutting head with water for removing dust entering into this gap, which, however, is not the subject of the present invention. The amount of water required for this purpose is considerable in pit mining. One has to save on water and, above all, the emerging water is disturbing at the areas of the cutting machine and of the mine face. Particularly with weak sill any accumulation of water is extremely disadvantageous and such an accumulation of water on the sill can even have as a result that the cutting machine is sinking into the sill. It has already been proposed to control supply of the water, which is effected for the purpose of cooling the bits and of cooling the mine face, such that always only those bits are supplied with water which come into engagement with the mine face. Such control is effected by means of valves and during the severe pit mining operation it frequently occurs that these valves become untight so that again the amount of emerging water can be considerable. Water is also emerging if cutting operation is interrupted for any reasons. Manual interruption of the water supply is practically not feasible and would also result in great dangers. If the operator forgets to switch on the water supply, there exists the danger of spark formation which might result in explosions of marsh gas.

Now, it is an object of the invention to reduce the water consumption to a minimum without risking any dangers. The control process according to the invention essentially consists in that water supply to the cutting head is only given free with the rotational movement of the cutting head being switched on and with simultaneous switching on of at least one second operating condition, such as movement of the cutting arm in left-hand direction, movement of the cutting arm in right-hand direction, upward movement of the cutting arm, downward movement of the cutting arm or advancing movement of the machine. For effecting cutting work it is an imperative premise that the cutting head is rotating. This alone does, however, not yet result in a cutting work. Cutting work is effected only if a second operating condition supervenes. Cutting work can thus only be effected if simultaneously with rotation of the cutting head a movement of the cutting arm for the individual cuts on the mine face is effected or if in case a penetration shall be deepened or enlarged a movement of the cutting arm and advancing movement of the cutting machine is effected simultaneously with rotation of the cutting head or if for producing a smaller penetration the cutting machine is advanced in addition to rotation of the cutting head. It is thus obvious that the rotation of the cutting head is a premise at any rate and that only if a second operating condition is supervening effective cutting work is done. By controlling the water supply in dependence on the rotational drive of the cutting head and on the simultaneous occurrence of a further operating condition makes thus sure that water is emerging only if effective cutting work is done, which results in reducing the water consumption to a minimum. The process can be performed such that supply of water to the cutting head is put in readiness when switching on the rotational movement of the cutting head and is given free when switching on the second operating condition. Thus it becomes possible to make release of the water supply dependent on, for example, the position of a control lever for switching-on the second operating condition. According to a preferred embodiment of the invention the process is, however, performed such, that supply of water is put in readiness when switching-on the rotational movement of the cutting head and is given free on a pressure rise in at least one of the hydraulic aggregates effecting pivotal movement of the cutting arm or advancing movement of the cutting machine. These hydraulic aggregates are the pivoting cylinders for the pivotal movements of the cutting arms and the hydraulic drive motor for advancing movement. In case of an electric drive of the chassis, a hydraulic pressure transmitter can be coupled with the abutment member. This provides the advantage that water supply is only switched on if the second operating condition is actually occurring and, furthermore, the control device is thus simplified.

The apparatus for performing the control process is essentially characterized by a water pump for supplying water to the cutting head, the switching-on device of which is coupled with the switching-on device for the rotational drive of the cutting head and within the pressure conduit of which an openable water shut-off valve is interpositioned, and by at least one pressure-sensitive member being subjected by the pressure within hydraulic aggregates effecting pivotal movement of the cutting arm and advancing movement of the cutting machine and directly or indirectly acting on the water shut-off valve in the sense of opening this valve. In view of the water pump being switched-on and switched-off simultaneously with the rotational drive of the cutting head, the water is under pressure before the shut-off valve. Actual release of water supply to the cutting head is, however, only effected if the pressure-sensitive member is opening this shut-off valve when switching on a second operating condition.

In a preferred embodiment of the invention the arrangement is such that several control pistons are arranged within a common cylinder and a conduit is opening into the working space of each control piston, each conduit being in connection with the working space of one of the hydraulic aggregates and the control pistons being coupled one with the other by engagement in direction of the applied pressure and being loaded by a spring in opposite direction to the pressure applied and are directly or indirectly acting on the water shut-off valve against the action of the spring in the sense of opening this valve. Thus, a stack of pistons is guided within the common cylinder. Irrespective which working space is subjected by the pressurized fluid, the pistons arranged between this working space and the spring are shifted in direction to the spring and cause the shut-off valve to open. Preferably, the water shut-off valve is indirectly actuated by the control pistons through the intermediary of a hydraulic pressurized fluid. In this case the arrangement is according to the invention such, that the water shut-off valve is actuated by a hydraulic piston and the pressure-sensitive member or the control pistons are controlling the supply of pressurized fluid to the hydraulic piston. In this manner, the water supply is separated from the hydraulic control aggregate and the danger is avoided that in case of a break down failure, water is entering into this control aggregate. According to an advantageous practical embodiment of the invention, the arrangement is such that the last control piston as seen in direction to the spring is striking against a stem in its turn opening the pressurized fluid valve by striking against its closure member, for example the ball of a pressurized fluid valve controlling supply of pressurized fluid to the hydraulic piston, that the stem is sealingly guided within a guide means subdividing the space accomodating the stem into a space located adjacent the pressurized fluid valve and into a space located remote from the pressurized fluid valve, that a conduit leading to the working space of the hydraulic piston is opening into the space located adjacent the pressurized fluid valve, that a return conduit leading to a pressurized fluid tank is opening into the space located remote from the pressurized fluid valve and that the stem has an axial bore being open in direction to the space located remote from the pressurized fluid valve and opening at the front surface striking the closure member of the pressurized fluid valve and becoming closed by striking said closure member.

Figure 2:
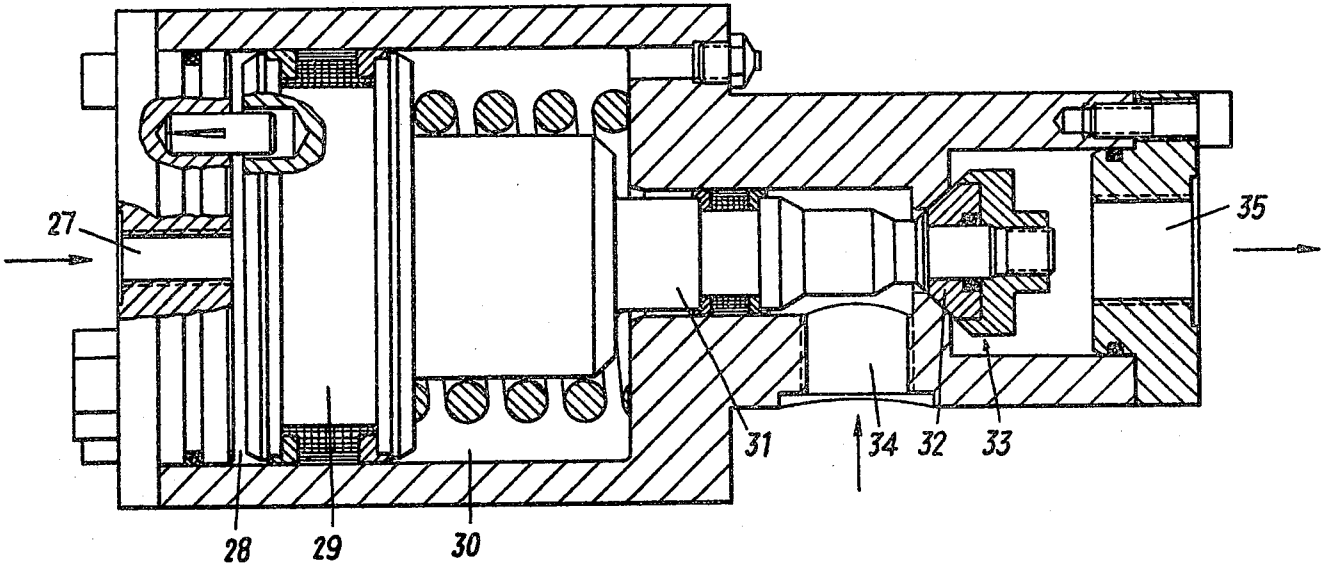

In the drawing, the invention is schematically illustrated with reference to an embodiment. FIG. 1 shows an axial section through the pressure-sensitive member and FIG. 2 shows the water shut-off valve together with the hydraulic piston in an axial section.

The pressure-sensitive member shown in FIG. 1 has a cylinder 1 within which are guided the control pistons 2, 3, 4, 5 and 6. The control pistons are coupled one with the other by means of bosses 7 and supported against these bosses by means of a spring 8. Connections for hydraulic conduits 15, 16, 17, 18 and 19, which are connected to the working spaces of the various hydraulic aggregates or, respectively, the pressure conduits leading thereto, are opening into the working spaces 9, 10, 11, 12 and 13 of these pistons 2 to 6. One of these conduits 15 to 19 each is, for example, opening into the working space of the hydraulic cutting cylinder which effects pivotal movement in left-hand direction, in right-hand direction, in upward direction and in downward direction. A further conduit is opening into the working space of the hydraulic drive motor or into the pressurized conduit thereof for effecting forward travel of the cutting machine. With an electric drive, the electric motor can, for example, actuate a pressurized fluid pump generating the pressure to be made effective within the respective working space. If thus one of the conduits 15 to 19 and thus one of the working spaces 9 to 13 is subjected to pressure, all control pistons 2 to 6 located at the right side of the working space 9 to 13 subjected to pressure are shifted in right-hand direction.

The last control piston 6 is acting on the stem 20, the front surface 21 of which is cooperating with the closure member or, respectively, the ball 22 of a hydraulic valve 23. When shifting the stem 20 in right-hand direction by means of the piston 6, the ball 22 is lifted off its seat and the pressurized fluid entering via the connection 24 can flow into the annular space 25 and from this space into a connection 26 for a conduit, This connection 26 is, via a conduit not shown, connected with a connection 27 opening into the working space 28 of a hydraulic piston 29 being guided within a cylinder 30. The hydraulic piston is via a piston rod 31 actuating the valve cone 32 of a water shut-off valve 33 and is lifting this valve cone. The water is thus allowed to flow via the valve 33 from an inlet 34 to an outlet connection 35. Upstream of the inlet connection 34 or downstream of the outlet connection 35, a shut-off valve not shown is arranged which is in open position when switching-on the rotational movement of the cutting head. If both valves are in open position, effective cutting work can be done and it is only with said both valves being in open position that supply of water to the cutting head is given free.

If none of the working spaces 9 to 13 is subjected to pressure, i.e. if water supply to the cutting head shall be shut-off, all of the pistons 2 to 6 are pressed by the spring 8 in left-hand direction into their starting position. For making possible return movement of the hydraulic piston 29, the pressurized fluid must be allowed to flow out of the working space 28. The stem 20 has an axial bore 36. The space accomodating the stem is subdivided into a space 25 located adjacent the pressurized fluid valve 23 and into a space 38 located remote from the pressurized fluid valve 23 by means of a fluid-tight guide means 37. The axial bore 36 of the stem 20 is in connection with the space 38 via radial bores 39. The axial bore 36 is opening at the front surface 21 of the stem 20. If the stem is with its front surface 21 pressing in upward direction of the ball 22, the mouth of the bore 36 at the front surface 21 is closed by the ball 22. Pressurized fluid can thus flow into the working space 28 exclusively via the connection 26. If the stem 36 is returning, the mouth at the front surface 21 is given free and the pressurized fluid can flow out of the working space 28 via the connections 27 and 26 and via the axial bore 36 into the space 38 and from there back to the pressurized fluid tank via a connection 40.

We claim:

1. Apparatus for controlling water flow to a cutting head of a cutting machine of the kind which has a plurality of hydraulically operated components, said apparatus comprising: a normally closed water control valve assembly having an inlet adapted to be connected to a source of water under pressure and an outlet adapted to be connected to a cutting head of a cutting machine, a hollow control cylinder; a plurality of axially aligned independently slidable control pistons disposed in said cylinder, said pistons being engageable with each other and the ends of said pistons and said cylinder forming a working space for each piston; biasing means biasing all said pistons in a given direction; a hydraulic connection corresponding to and in communication with each working space, each of said connections being adapted to be connected to a different hydraulic component of a cutting machine, the arrangement being such that fluid pressure applied to the working spaces tends to move the pistons against the bias of said biasing means, said pistons during such movement acting directly or indirectly to open said water control valve assembly.

2. Apparatus as in claim 1 wherein said water control valve assembly includes a hydraulically movable piston and a hydraulic fluid inlet adapted for connection to a source of hydraulic pressure and wherein movement of said pistons against the bias of said biasing means opens said hydraulic fluid inlet to thereby cause said water control valve assembly to open.

3. Apparatus as in claim 1 wherein said water control valve assembly includes a piston and cylinder unit having a hydraulic fluid inlet and a water valve member movable to an open position by movement of said piston by hydraulic pressure applied to said hydraulic fluid inlet, said apparatus further including a pressurized fluid valve having an inlet adapted for connection to a source of hydraulic pressure, an outlet and a movable valve element normally closing a passage between said inlet and said outlet; a movable stem cooperating with said control pistons in said control cylinder and with said movable valve element in a manner such that movement of said pistons against the bias of said biasing means causes said valve element to open said passage thereby passing hydraulic pressure to the hydraulic fluid inlet of said water control valve assembly, said stem being sealingly guided within a guide means subdividing a space accommodating the stem into a first space located adjacent the pressurized fluid valve and into a second space located remote from the pressurized fluid valve, said first space being in communication with the hydraulic inlet of said water control valve assembly; a return conduit leading to a pressurized fluid tank opening into said second space, said stem having an axial bore open in direction to said second space and opening at the adjacent surface facing said movable valve element of said pressurized fluid valve and becoming closed by striking said movable valve element.

4. Apparatus for controlling water flow to a cutting head of a cutting machine of the kind which has a plurality of hydraulically operated components, said apparatus comprising: a hollow control cylinder; a group of independently slidable pistons arranged axially in said cylinder; bias means acting on the piston at one end of the group of pistons to bias said pistons in a first direction such that the piston at the other end of said group engages an end of the cylinder and such that said pistons engage each other end-to-end, the ends of said pistons and the cylinder forming a working space for each piston; a hydraulic connection corresponding to and in communication with each working space, each connection being adapted to be connected to a different hydraulic component of a cutting machine, whereby fluid pressure applied to a given working space tends to move those pistons located between said given working space and said bias means in a direction opposite to the bias direction; and a normally closed water control valve assembly having an inlet adapted to be connected to a source of water under pressure and an outlet adapted to be connected to a cutting head of a cutting machine, said valve assembly opening in response to movement of the piston at said one end of said group in a direction opposite the bias direction.

* * * * *